US012385649B2

(12) United States Patent
Becke et al.

(10) Patent No.: US 12,385,649 B2
(45) Date of Patent: Aug. 12, 2025

(54) COOKING SYSTEM HAVING A COORDINATING DEVICE FOR A TARGET COOKING-TIME END WHICH IS APPLICABLE IN COMMON

(71) Applicant: BSH Hausgeräte GmbH, Munich (DE)

(72) Inventors: Christoph Becke, Grosskarolinenfeld (DE); Barbara Heikel, Traunstein (DE); Anna Raveling, Munich (DE); Ragnar Somdalen, Vachendorf (DE); Nadine Wolf, Grünwald (DE); Edith Wrehde, Nußdorf (DE)

(73) Assignee: BSH Hausgeräte GmbH, Munich (DE)

( * ) Notice: Subject to any disclaimer, the term of this patent is extended or adjusted under 35 U.S.C. 154(b) by 357 days.

(21) Appl. No.: 18/007,758

(22) PCT Filed: Sep. 9, 2021

(86) PCT No.: PCT/EP2021/074806

§ 371 (c)(1),
(2) Date: Dec. 2, 2022

(87) PCT Pub. No.: WO2022/063593

PCT Pub. Date: Mar. 31, 2022

(65) Prior Publication Data

US 2023/0272921 A1 Aug. 31, 2023

(30) Foreign Application Priority Data

Sep. 24, 2020 (DE) ..... 102020212057.9

(51) Int. Cl.
*F24C 7/08* (2006.01)

(52) U.S. Cl.
CPC ..... *F24C 7/087* (2013.01); *F24C 7/085* (2013.01)

(58) Field of Classification Search
CPC ..... F24C 7/087; F24C 7/085
See application file for complete search history.

(56) References Cited

U.S. PATENT DOCUMENTS

2006/0185810 A1 8/2006 Juergens
2011/0070340 A1 3/2011 Pechaigner
(Continued)

FOREIGN PATENT DOCUMENTS

DE 102015112865 A1 2/2017
DE 102018211925 A1 1/2020
EP 2085700 A2 8/2009

OTHER PUBLICATIONS

National Search Report DE 102020212057.9 dated Jun. 21, 2021.
International Search Report PCT/EP2021/074806 dated Dec. 8, 2021.

*Primary Examiner* — Thien S Tran
(74) *Attorney, Agent, or Firm* — Michael E. Tschupp; Andre Pallapies; Brandon G. Braun

(57) ABSTRACT

A cooking system includes at least two individually controllable cooking stations. Each cooking station is operably connected to a degree of cooking monitoring apparatus which ascertains a degree of cooking of food to be cooked at the cooking station. A coordinating facility is connected to the cooking stations for data communication and sets operating parameters of the cooking stations and receives a target cooking time end common for the cooking stations. The cooking system determines during a cooking process running at the cooking stations an expected cooking time end in response to an ascertained degree of cooking, and adapts in the event that the expected cooking time end for at least one of the cooking stations does not match the common target cooking time end an operating parameter for the this cooking station such that the common target cooking time end is achieved during running operation by this cooking station.

8 Claims, 4 Drawing Sheets

(56) References Cited

U.S. PATENT DOCUMENTS

| | | | | |
|---|---|---|---|---|
| 2014/0292536 | A1 | 10/2014 | Barth | |
| 2017/0224148 | A1* | 8/2017 | Koennings | G05B 19/0426 |
| 2018/0103803 | A1 | 4/2018 | Laub | |
| 2020/0033811 | A1 | 1/2020 | Helms | |

* cited by examiner

COOKING SYSTEM HAVING A COORDINATING DEVICE FOR A TARGET COOKING-TIME END WHICH IS APPLICABLE IN COMMON

CROSS-REFERENCES TO RELATED APPLICATIONS

This application is the U.S. National Stage of International Application No. PCT/EP2021/074806, filed Sep. 9, 2021, which designated the United States and has been published as International Publication No. WO 2022/063593 A1 and which claims the priority of German Patent Application, Serial No. 10 2020 212 57.9, filed Sep. 24, 2020, pursuant to 35 U.S.C. 119 (a)-(d).

The contents of International Application No. PCT/EP2021/074806 and German Patent Application, Serial No. 10 2020 212 57.9 are incorporated herein by reference in their entireties as if fully set forth herein.

BACKGROUND OF THE INVENTION

The invention relates to a cooking system, having at least two individually controllable cooking stations and a coordinating facility which is connected to said cooking stations for data communication and which is configured so as to set operating parameters of the cooking stations and to receive a target cooking time end that applies in common for the cooking stations. The invention also relates to a method for operating such a cooking system that comprises at least two individually controllable cooking stations. The invention can be applied particularly advantageously to household cooking appliances and their cooking stations.

US 2020033811 A discloses a method for synchronizing the cooking time. The method includes synchronizing a cooking time in one of multiple cooking appliances, wherein a user has selected the remaining cooking time on one of the other of the multiple cooking appliances. The method also includes: (a) transmitting a remaining cooking time of one of the multiple cooking appliances via a network to the one of the multiple cooking appliances; and/or (b) requesting the remaining cooking time from the respective other one of the multiple cooking appliances via the network as a response to a user input in the case of the one of the multiple cooking appliances.

DE 10 2018 211 925 A1 discloses a household appliance apparatus having at least one food container that comprises at least one interface, having at least one further food container that comprises at least a further interface, having a base unit that comprises at least one corresponding interface which is designed corresponding to the interfaces of the food container and with which the food container can be coupled individually to the base unit. In order to improve flexibility, it is proposed that the household appliance apparatus has at least one control unit that is provided so as to individually activate the food container in at least one coupled state of the food container to the base unit for the individual preparation of food. The control unit can be provided for the individual preparation of food so as to activate at least one of the food containers in a time delayed manner.

EP 3 311 716 A1 discloses a computer-implementable method for controlling a multiplicity of individually addressable and individually controllable food storage units in a modular food storage container, wherein the method comprises the following: (a) receiving, at a user station via a user interface, parameter values that can be set by user selections for a multiplicity of settable parameters according to adaptable operating aspects of the food storage units; (b) transmitting the settable parameter values to a control unit of the modular food storage container, wherein the settable parameter values are transmitted as one or multiple settable load components to the control unit; executing a control program during the run time by a processor of the control unit, wherein the program includes program instructions for the operation of at least one of the food storage units, wherein the execution of the control program has the access to the settable parameter values by the one or the multiple settable load components; and (c) controlling the operation of the at least one food storage unit by the processor of the control unit in accordance with the settable parameter values, wherein (d) the user station is arranged remote from the modular food storage container; (e) the transmission of the settable parameter values to the control unit of the modular food storage container includes the communication of the one or multiple settable load components via the communication network to the modular food storage container; and (f) wherein the transmission of the settable parameter values to the control unit of the modular food storage container further includes the following: (g) via the communication network during use accessing version information, which is allocated to the settable parameter values, by way of the control unit of the modular food storage container; (h) identifying an updated version of the settable parameter values by a processor of the user station; and (i) communicating the updated version of the settable parameter values in the one or the multiple settable load components via the communication network to the modular food storage container. The multiplicity of settable parameters, which correspond to the adaptable operating aspects of the food storage units, demonstrate general parameters that are allocated to a recipe, including temperature parameters and time control parameters. The time control parameters can have a run time that is allocated to the recipe.

BRIEF SUMMARY OF THE INVENTION

It is the object of the present invention to overcome at least in part the disadvantages of the prior art and in particular to provide an improved possibility of regularly terminating at the same point in time multiple cooking processes that are running in different cooking stations.

This object is achieved in accordance with the features of the independent claims. Advantageous embodiments are the subject matter of the dependent claims, the description and the drawings.

The object is achieved by a cooking system, having at least two individually controllable cooking stations and at least one coordinating facility which is connected to said cooking stations for data communication and which is configured so as to set operating parameters of the cooking stations and to receive a target cooking time end that applies in common for the cooking stations, wherein each of the cooking stations is allocated at least one degree of cooking monitoring apparatus that is configured so as to ascertain a degree of cooking of food to be cooked that is located at the respective cooking station, wherein the cooking system is configured so as:

during the cooking processes that are running at the cooking stations to determine with the aid of a respectively ascertained degree of cooking of the food to be cooked a respective expected cooking time end and in the event that an expected cooking time end for at least one cooking station or at least one cooking process does not match the target cooking time end, to adapt by means of the coordinating facility at least one operating parameter for this cooking station in such a way that the target cooking time end is achieved during the running operation by this cooking station.

This cooking system produces the advantage that, by temporally adapting an operating time or run time of at least one of multiple parallel running cooking processes, it is possible to achieve a common target cooking time end with a greater degree of probability without a quality of the cooking result being noticeably reduced.

The at least two individually or separately controllable cooking stations can be present in an identical cooking appliance (for example cooker, hob, double-oven) or in different cooking appliances. Fundamentally, the cooking system can comprise an unlimited number of cooking stations in any combination as a single appliance or a combination appliance.

A cooking station is understood in particular to be a cooking apparatus on which food to be cooked can be cooked or a cooking process can be performed. A cooking station can comprise by way of example:

- a cooking compartment, for example of an oven, of a microwave appliance, of a steam cooking appliance or of any combination thereof, for example of an oven having a microwave function and/or a steam treatment function;
- a cooking zone of a hob;
- a grill, teppanyaki; etc.

Food to be cooked that is located "at" a cooking station can include for example a food to be cooked that is arranged in a cooking compartment or is arranged on a cooking zone.

It is one development that a cooking station is integrated into a household cooking appliance or corresponds to a household cooking appliance. In particular, a household cooking appliance can have one or multiple cooking stations.

By virtue of the fact that the cooking stations can be individually controllable, they can be operated as required also without the use of a specification of a common target cooking time end, for example according to the conventional type of household cooking appliances. The functionality of the individual household cooking appliances is thus advantageously not limited by the present method.

The coordinating facility can serve in particular as a central input medium and/or control medium for the cooking stations. The coordinating facility can have a user interface, for example for the user to input the desired target cooking time end, so as to display a cooking progress, a remaining run time until the target cooking time end has been achieved, etc. Said coordinating facility can be equipped for this purpose for example with a touchscreen.

It is one development that the coordinating facility is a dedicated or stand-alone apparatus.

It is one development that the coordinating facility is a user terminal, in particular integrated in a mobile user terminal, such as a smartphone, tablet computer etc. The function of the coordinating facility can then be converted in particular by running a corresponding application program on the user terminal.

It is one development that the coordinating facility is integrated into one of the cooking appliances that has at least one of the cooking stations.

It is one development that the cooking system has precisely one coordinating facility. It is one development that the cooking system multiple coordinating facilities, for example respective coordinating facility that is provided on some or all the cooking appliances. In the latter case, one of the coordinating facilities can be active, the other passive, for example in a similar manner to a master-slave arrangement. The active coordinately facility can be by way of example the particular coordinating facility on which a user plans a menu or on which the user inputs data and which then also monitors the cooking processes. The multiple coordinating facilities can advantageously synchronize with one another, in other words that a data synchronization between the active coordinating facility and the at least one passive coordinating facility takes place. However, it is also possible that the passive coordinating facilities do not appear functionally, therefore they are transparent for the adaptation of the operating parameters etc.

The cooking stations can be for example wire-connected or wireless connected for data communication to the coordinating facility, for example via an Ethernet connection, WLAN or Bluetooth connection.

The operating parameters of the cooking stations can include operating parameters that can be set by a user, such as a cooking compartment temperature, a selection of heating bodies (for example bottom heat, top heat, grill operation, hot air or any arbitrary combination thereof), a wattage for a microwave operation, a cooking phase etc. The operating parameters of the cooking stations can also include operating parameters that cannot be set by a user, such as an operation of a fan, an antenna position or rotational speed of a microwave rotating antenna, etc.

The operating parameters that can be set by a user can be input by a user at the coordinating facility and/or automatically retrieved from a recipe database.

The coordinating facility being configured so as to set operating parameters of the cooking stations includes that the coordinating facility can transmit values of operating parameters to the cooking stations or to the associated cooking appliances, which are accepted by the cooking stations or associated cooking appliances for the cooking processes that are running thereon.

The coordinating facility being configured so as, and to receive a target cooking time end which applies in common for the cooking stations includes in particular that a user can set the target cooking time end on it. Alternatively, the target cooking time end can be received via remote control at the coordinating facility, for example via a network from a user terminal if by way of example a user is located outside the house.

It is one development that specific cooking stations can be allocated to the coordinating facility, for example automatically or by a user. By way of example, all the fundamentally available cooking stations can be displayed for a desired food preparation, for example in the form of a list, and cooking stations that are to be used can be selected therefrom.

A degree of cooking monitoring apparatus can be understood to be any apparatus that is configured so as to determine a degree of cooking of the food to be cooked that is prepared at the cooking station. The degree of cooking can by way of example include a browning degree of the food to be cooked, a core temperature of the food to be cooked, etc. A degree of cooking monitoring apparatus can comprise at least one sensor, such as a camera, an IR sensor, a temperature sensor, etc., wherein the degree of cooking is determined in a fundamentally known manner by evaluating the measurement values of the at least one sensor.

Each of the cooking stations being allocated a degree of cooking monitoring apparatus can include that each of the cooking stations is allocated at least one dedicated degree of cooking monitoring apparatus. It is also possible for multiple cooking stations to share one degree of cooking monitoring apparatus.

It is fundamentally known to determine a respective expected cooking time end with the aid of the ascertained degree of cooking. The expected cooking time end is the particular predicted point in time at which the food to be cooked that is cooking or has been prepared at a cooking station has finished cooking. By way of example, a prevailing specific degree of cooking can be compared with stored table values or a characteristic curve and from that the residual cooking time and similarly thereto the target cooking time end (from the addition of the prevailing time to the residual cooking time) can be determined. It is also possible to conclude the target cooking time end from a temporal progression of the degree of cooking, by way of example by evaluating characteristic values of the curve of the degree of cooking (for example from extreme points) or by way of curve extrapolation.

The cooking system being configured so as to adapt at least one operating parameter for a cooking station includes in particular that the coordinating facility communicates the at least one adapted or changed operating parameter to the household cooking appliance and it is accepted by the household cooking appliance for setting the cooking station.

The cooking system being configured so as to adapt at least one operating parameter for a cooking station in such a way that the target cooking time end is reached "during the running operation" of this cooking station includes that the cooking process is kept continuously running. Not included is consequently that the operation of the cooking station is interrupted so as to extend the cooking process, for example in that an energy supply to the food to be cooked is interrupted for a period of time that is determined by the target cooking time end, for example by switching off all the heating sources.

The method can include that precisely one target cooking time end is predetermined. It can also include that multiple target cooking time ends are predetermined for different (in each case multiple) cooking stations. In the latter case, the advantage is achieved that different groups of food to be cooked can be completely cooked in a temporally staggered manner, by way of example with regard to the respective joint completion of each food within the scope of a menu (for example starter, first course, second course, dessert, etc.).

It is one embodiment that, if an expected cooking time end for one cooking station is later than the common target cooking time end, the cooking system is configured so as to adapt at least one operating parameter for this cooking station in such a way that an associated cooking time is reduced. As a result, a cooking process that is initially running too slowly can also achieve the target cooking time end without causing a quality of a desired cooking result to noticeably deviate from a cooking process that has not been adapted.

The reduction of the cooking time can be achieved in one development by increasing the energy (temperature, microwave power, etc.) that is introduced into the food to be cooked, for example by increasing a cooking compartment temperature, a wattage of a microwave oven etc. The increase of the energy that is introduced into the food to be cooked can be achieved by way of example by increasing at least one heating source that is already present in the operation, such as a resistance heating element and/or by switching at least one further resistance heating element, a microwave generator, by introducing hot steam etc.

It is one embodiment that, if an expected cooking time end for a cooking station is earlier than the target cooking time end, the cooking system is configured so as to adapt at least one operating parameter for this cooking station in such a way that an associated cooking time is extended. As a result, the target cooking time end can advantageously also be achieved by a cooking process that is initially running too quickly without a quality of a desired cooking result noticeably deviating from a cooking process that has not been adapted. In particular, the target cooking time end can be achieved without having to interrupt the associated cooking process. By avoiding an interruption of the cooking process, it is possible to prevent cakes or soufflés collapsing and to prevent food being undesirably after-cooked, hardened, softened, etc.

The extension of the cooking time can be achieved in one development by reducing the energy (temperature, microwave power, etc.) that is introduced into the food to be cooked, for example by lowering a cooking compartment temperature, a wattage of a microwave oven etc. The reduction of the energy that is introduced into the food to be cooked can be achieved by way of example by reducing at least one heating source that is already in operation, such as a resistance heating element, and/or by switching off at least one resistance heating element, one microwave generator, by introducing cooling air, etc.

It is one development that the target cooking time end is allocated a (temporal) tolerance band, wherein the cooking system is configured so as to adapt at least one operating parameter for a cooking station only if the expected cooking time end is outside the tolerance band. The advantage is thus achieved that it is avoided having to also adapt the at least one operating parameter if a difference between the expected cooking time end and the target cooking time end is merely very small, for example is less than 30 s or 1 min.

It is one embodiment that, if for a specific cooking station an expected cooking time end cannot be matched to the common target cooking time end, the cooking system is configured so as to adapt the common target cooking time end to the expected cooking time end of this cooking station. The advantage is thus achieved that, for the event that it is no longer possible for all the provided cooking processes to finish cooking at the previously set target cooking time end (where appropriate taking into consideration the tolerance band), the possibility is created for a new target cooking time end for all the cooking processes to be found. For this purpose, a check is performed as to whether the operating parameter of the other cooking stations can be adapted to a new common target cooking time end. If this is the case, the cooking system, in particular the coordinating facility, can accordingly adapt the operating parameters of the other cooking stations. It not being possible for an expected target cooking time end for a specific cooking station to be matched to the common target cooking time end can include that the cooking duration for a specific cooking station or cooking process can no longer be reduced or extended in such a way that the previously applicable target cooking time end is achieved. This case can arise by way of example even if by changing the operating parameters the previously applicable target cooking time end can no longer be achieved and/or if a cooking result of this cooking process would be adversely affected.

It is one development that the target cooking time end is automatically adapted, where appropriate by outputting a message to a user. It is one embodiment that the target cooking time end is only adapted when approval is issued by a user—optionally prior to the end of a predetermined waiting period.

It is one development that the cooking system is configured so as to adapt the common target cooking time end to an expected cooking time end of the particular cooking station, whose expected cooking time end cannot be matched to the previously set target cooking time end which is temporally the closest to the previously set target cooking time end. In other words, the cooking system is configured so as to change the previously set target cooking time end in such a way that it then matches an expected cooking time end of this cooking station which is temporally closest to the previously set target cooking time end. As a result, the previously set target cooking time end is advantageously temporally changed as little as possible.

In addition or alternatively, other calculation specifications can also be used in order to adapt the cooking time end. It is thus possible to adapt the target cooking time end in such a way that a deviation (for example standard deviation) of the expected cooking time ends of all the cooking stations from the target cooking time end is minimal, etc.

It is one development that the cooking system is configured so as to leave the original set target cooking time end unchanged until it has been achieved. It is one embodiment that, if for a specific cooking station an expected cooking time end cannot be matched to the target cooking time end, the cooking system is configured for this purpose so as to set the cooking time end for this cooking station individually. This cooking station is then advantageously controlled in such a way (by setting the at least one operating parameter) that the expected cooking time end is temporally as close as possible to the (unchanged) target cooking time end. This embodiment is particularly advantageous if the originally input target cooking time end is not to be changed or cannot be changed. In the event that the above condition arises, an appropriate message can be output to a user.

It is one embodiment that the cooking system is configured so as for at least one of the cooking stations or for each cooking process to specify a cooking time range ("cooking time limit range") that is delimited by a minimum cooking duration that is permissible with regard to the associated cooking process and a maximum permissible cooking duration. Such a cooking process can therefore not be reduced or extended in an arbitrary manner. As a result, the advantage is achieved that an adverse effect on a cooking result due to a cooking time being too short or too long is prevented. Also, it is thus advantageously easier to determine whether a cooking process that is running at a cooking station can be set or not to a target cooking time end that has been adapted on the basis of another cooking station or cooking process. Moreover, this can simplify the creation of a timetable for the parallel cooking at multiple cooking stations.

The cooking time limit range is dependent upon the food to be cooked that is to be treated and/or its preparation mode ("recipe"). It is one development that the cooking time limit range is determined, for example calculated and/or or retrieved from a database, prior to the start of the associated cooking process. It is one development that the cooking time limit range is determined again during the associated cooking process, for example on the basis of a last-determined degree of cooking. This is advantageous in order to be able to reliably maintain a good cooking result.

It is one embodiment that the cooking system is configured so as to specify start times individually for the cooking processes that are allocated to the cooking stations. Thus, the advantage is achieved that the start times can be specified for cooking processes of different durations in such a way that their common target cooking time end is achieved in a particularly reliable manner. The start times or normal cooking durations of the cooking processes can be input by a user or automatically predetermined, for example on the basis of an electronic recipe or cookbook or a timetable. The initially set, not yet adapted operating parameters can also generally correspond to a recipe being performed and/or to values that are predetermined by a user, for example with regard to a cooking compartment temperature, cooking phase, etc.

It is one embodiment that the cooking system is configured so as, prior to the start of the cooking processes, to create a timetable for a food preparation using multiple cooking stations and to determine therefrom together with the initially specified target cooking time end the different start times of the operation of the cooking stations or of the cooking processes.

It is also possible in this case in one development to display to the user by means of the coordinating facility a proposal for a temporally more efficient or (temporally longer) classic preparation.

It is one development that so as to create the timetable use is made of information regarding a time that is available for performing the entire food preparation; the cooking stations that are coupled to the communication apparatus and are available/selected for the food preparation; the cooking time limit ranges of the food to be cooked at the participating cooking stations and/or an average duration of manual work steps. This information can be retrieved from an electronic cookbook or from a different database and/or can be input by a user. By way of example, a user can create a timetable at 9:00 AM in order to be able to present guests at 07:00 PM a dish which requires multiple cooking stations for its preparation. For this purpose, a user calls up an application program ("app") on their smartphone or tablet computer, by means of which the timetable can be created and the associated cooking sequences monitored and controlled. Subsequently, the user searches for the dish that is to be prepared/menu from an electronic cookbook, for example via the Internet. The usual (standard) cooking durations and where appropriate cooking time limit ranges of the food to be cooked that is to be prepared separately are stored and in the cookbook are retrievable. The application program calculates from this information together with the initially specified target cooking time end the respective start times of the cooking processes that are to be performed in parallel and where appropriate the start of the food preparation, at which a user should start at the latest with the preparation of the food, including manual working steps. If the timetable is approved by the user, the selected cooking stations are started at respective start times at which the food to be cooked that is located therein should be ready at the common target cooking time end using the operating parameters set by a user. This can include that a cooking station or a cooking process is only automatically started in a temporally controlled manner if it is determined prior to loading the cooking station with food to be cooked, by way of example automatically (for example by object recognition) or by means of an input by a user.

The object is also achieved by a method for operating a cooking system, having at least two individually controllable cooking stations, wherein during a running cooking operation a respective expected cooking time end is determined for each of the cooking stations with the aid of a respective ascertained degree of cooking and in the event that an expected cooking time end for at least one cooking station does not match a target cooking time end that is common for all the cooking stations, at least one operating parameter is adapted for this at least one cooking station in such a way that the common target cooking time end is achieved during the running operation by this at least one cooking station.

The method is designed in a similar manner to the cooking system, and vice versa, and has the same advantages.

BRIEF DESCRIPTION OF THE DRAWINGS

The above described characteristics, features and advantages of this invention and the manner in which these are achieved are clearer and more easily understood in connection with the following schematic description of an exemplary embodiment that is further explained in connection with the drawings.

DETAILED DESCRIPTION OF EXEMPLARY EMBODIMENTS OF THE PRESENT INVENTION

Figure 1:
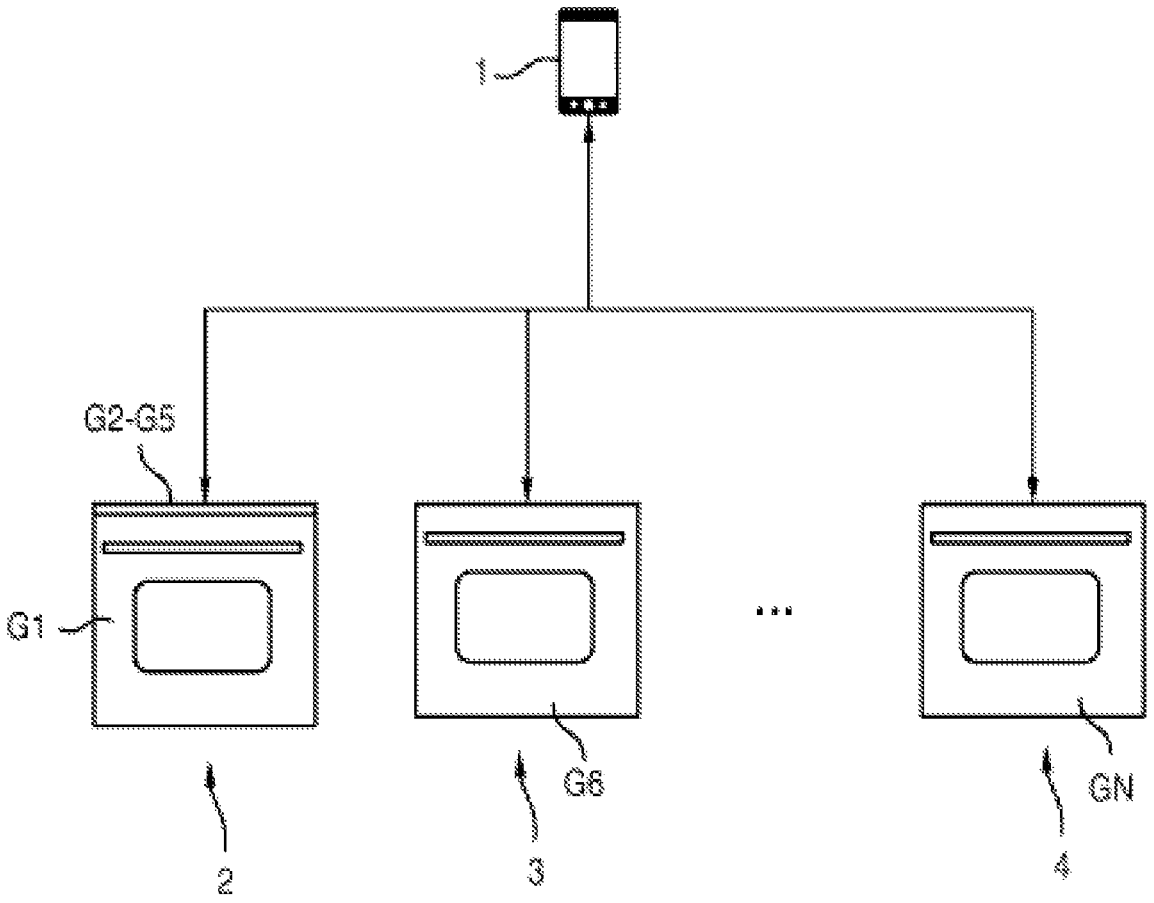
FIG. 1 shows a cooking system having a coordinating facility and multiple cooking stations.

FIG. 1 shows an outline of a cooking system 1, G1 to G6, . . . , GN having a coordinating facility 1 in the form of a smartphone, which is equipped with a corresponding application program or "app", and N individually controllable cooking stations G1 to G6, . . . , GN. The first five cooking stations G1 to G5 are integrated into a cooker 2, namely a cooking compartment G1 and four cooking stations G2 to G5 of a hob. A steam cooking appliance 3 has a cooking station G6 in the form of a steam treatment compartment and a microwave oven 4 has a cooking station GN in the form of a microwave treatment compartment.

The coordinating facility 1 and the cooking stations G1 to GN or the associated household cooking appliances 2 to 4 are connected to one another for data communication, in particular in a bi-directional manner, for example via a wireless data transmission standard such as Bluetooth, WLAN, etc. The coordinating facility 1 is configured (programmed) so as by way of its app to set operating parameters of the cooking stations G1 to GN. The coordinating facility 1 can therefore serve as a remote control for the cooking stations G1 to GN or for the household cooking appliances 2 to 4. The operating parameters can be operating parameters that can set by a user and/or can be retrieved via a recipe database or they can be operating parameters that cannot be set by a user. The operating parameters can also be temporal progressions of individual operating parameters, for example a temperature profile.

Operating parameters for the cooking stations G1 to GN can include for example:

- a cooking compartment temperature or temperature profile and selection of the heating body (for example top heating body, bottom heating body, grill heating body and/or hot air heating body) of the cooking compartment G1;
- a respective cooking phase of the cooking stations G2 to G5, in the case of temperature cooling alternatively or in addition a food to be cooked temperature of food to be cooked that is placed on the cooking stations G2 to G5;
- a temperature and steam profile of the steam treatment compartment G6;
- a wattage of the microwave treatment compartment GN if in addition at least one electrical heating source such as a resistance heating element etc. should be present, also a temperature of the microwave treatment compartment GN and/or a heating power of the at least one resistance heating element.

A user can input at the coordinating facility 1 a target cooking time end that is applicable or provided in common for all or a part of the cooking stations G1 to GN.

Each of the cooking stations G1 to GN is allocated at least one degree of cooking monitoring facility (not shown), which is configured so as to ascertain a degree of cooking of food to be cooked that is located at (in other words in or on) the respective cooking station G1 to GN, for example a cooking compartment/treatment compartment temperature sensor, a camera, an IR sensor (for example an IR camera), a core temperature sensor etc. The degree of cooking that is ascertained from the measurement data (for example in the form of a browning degree, a core temperature, etc.) can be calculated in the respective household appliances 2 to 4 or in the coordinating facility 1.

Using the prevailing value of the degree of cooking and/or using the temporal progression of the degree of cooking values that is recorded during a cooking process, it is possible, for example by means of the coordinating facility 1, to determine an expected individual cooking time end that is associated with the respective cooking stations G1 to GN or with the cooking processes that are running at said cooking stations.

If a common target cooking time end has been set for the cooking stations G1 to GN or a selected part quantity thereof, it is possible, by means of the cooking system 1 to 4, G1 to GN, in particular by means of the coordinating facility 1, to perform a check as to whether the calculated expected individual cooking time ends for the cooking stations G1 to GN match the target cooking time end which is to be achieved in common. If this is not the case for at least one of the cooking stations G1 to GN, at least one operating parameter for this/these cooking station(s) G1 to GN can be adapted in such a way that the common target cooking time end is nevertheless achieved again during the running operation of this cooking station G1 to GN, because by adapting or changing the at least one operating parameter the following applicable expected individual cooking time end is accordingly reduced or extended.

By way of example, if an expected cooking time end for a specific cooking station G1 to GN or cooking process is temporally after the target cooking time end (which can be demonstrated or can arise for example only during a running cooking process), the coordinating facility 1 can adapt at least one operating parameter for this cooking station in such a way that an associated cooking time is reduced. This can be implemented in such a way that an amount of energy supplied to the food to be cooked is increased, by way of example by increasing the amount of power that is applied to a heating source (electrical resistance heating body, IR emitter, induction coil, microwave generator, etc.), by switching on at least a previously deactivated heating source, by generating hot steam, etc.

On the other hand, if an expected individual cooking time end for a specific cooking station or cooking process is temporally before the target cooking time end, the coordinating facility 1 can adapt at least one operating parameter for this cooking station in such a way that an associated cooking time is extended. This can be implemented in such a way that an amount of energy supplied to the food to be cooked is reduced, by way of example by reducing the amount of power that is applied to a heating source (electrical resistance heating body, IR emitter, induction coil, microwave generator, etc.), and/or by actively cooling the food to be cooked or the cooking compartment, by way of example by activating or boosting a cooling fan, etc.

Figure 2:
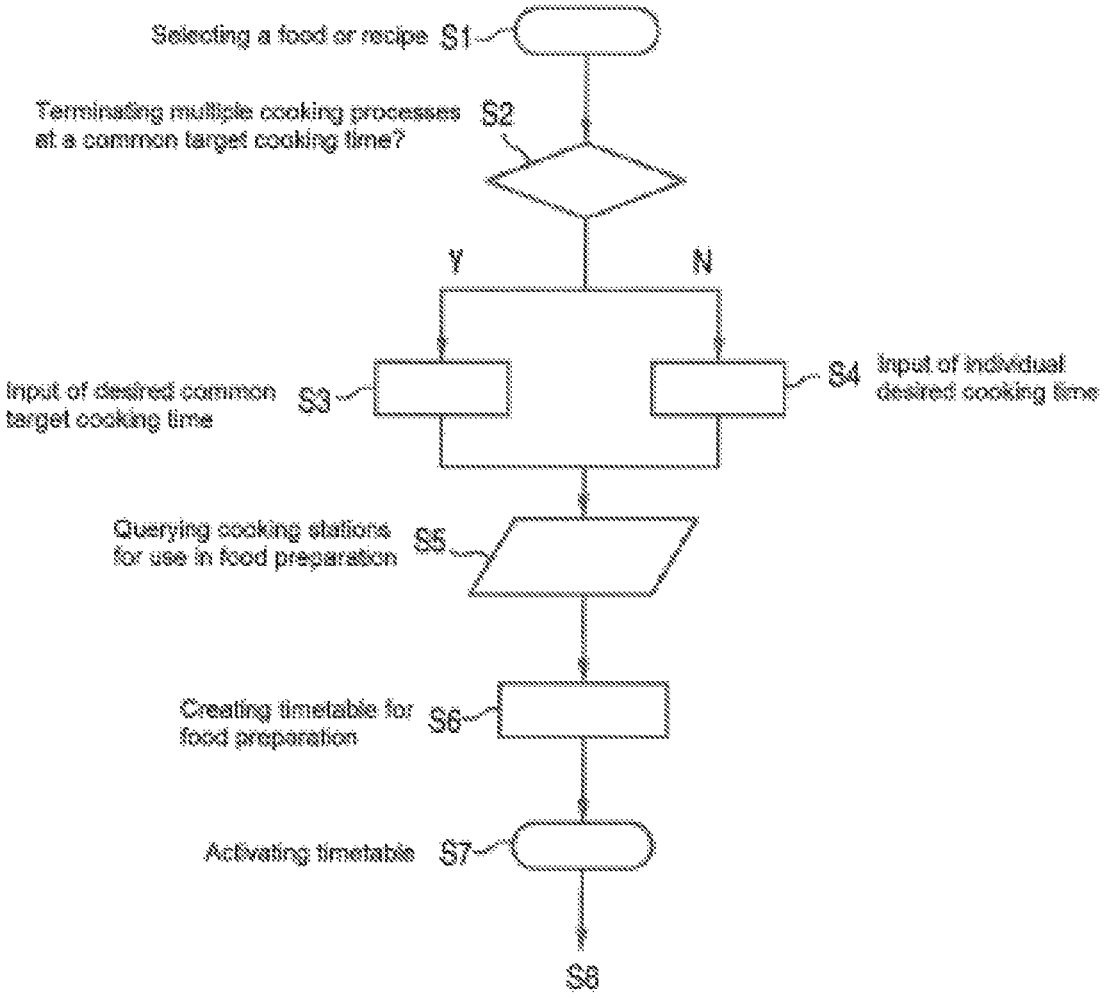
FIG. 2 shows method steps for operating the cooking system.

FIG. 2 shows method steps for operating a cooking system, specifically up to the activation of cooking processes. The method steps can be performed by way of example by means of the cooking system 1 to 4, G1 to GN from FIG. 1.

In a step S1, a user selects a food (menu) or recipe, by way of example from an electronic cookbook, for example via the coordinating facility 1, or from a conventional cookbook. It is assumed by way of example that in order to prepare the recipe more than one cooking station G1 to GN must be operated temporally in parallel, for example the cooking compartment G1 and at least one of the cooking stations G2 to G5.

In a step S2, it is queried by means of the coordinating facility 1 as to whether multiple cooking processes are to be terminated at a common target cooking time end. If this is the case ("Y"), in a step S3 the desired common target cooking time end is queried by the coordinating facility 1 and input for example by a user. If this is not the case ("N"), in a step S4, the individual desired cooking time ends for each cooking station G1 to GN is queried by the coordinating facility 1 and input for example by a user.

In a step S5 that follows both step S3 and also step S4, the cooking stations G1 to GN that are to be used for performing the food preparation are queried, for example from a list of all the cooking stations G1 to GN that can be controlled by the coordinating facility 1.

Following on in a step S6, a timetable for the food preparation can be created by means of the coordinating facility 1. This can output at least the start times of the difference selected cooking stations G1 to GN or of the associated cooking processes, where appropriate also the point in time at which a user should at the latest start with the food preparation. Possible input variables for creating the timetable can include by way of example a minimum and maximum allowed cooking duration of each cooking process, a usual duration of manual working steps, etc. These input variables can be downloaded from a database, for example from the (where appropriate user-individually tailored) electronic cookbook or input by the user.

The timetable can be checked by a user at the coordinating facility 1 and where appropriate changed.

In a step S7, the timetable is activated at the coordinating facility 1. The coordinating facility 1 then monitors the prevailing time, starts the individual cooking stations G1 to GN or cooking processes according to the start times that are determined from the timetable and ensures—if selected—that a common target cooking time end of the appropriately selected cooking stations G1 to GN is achieved, as is further explained in the following FIG. 3.

Figure 3:
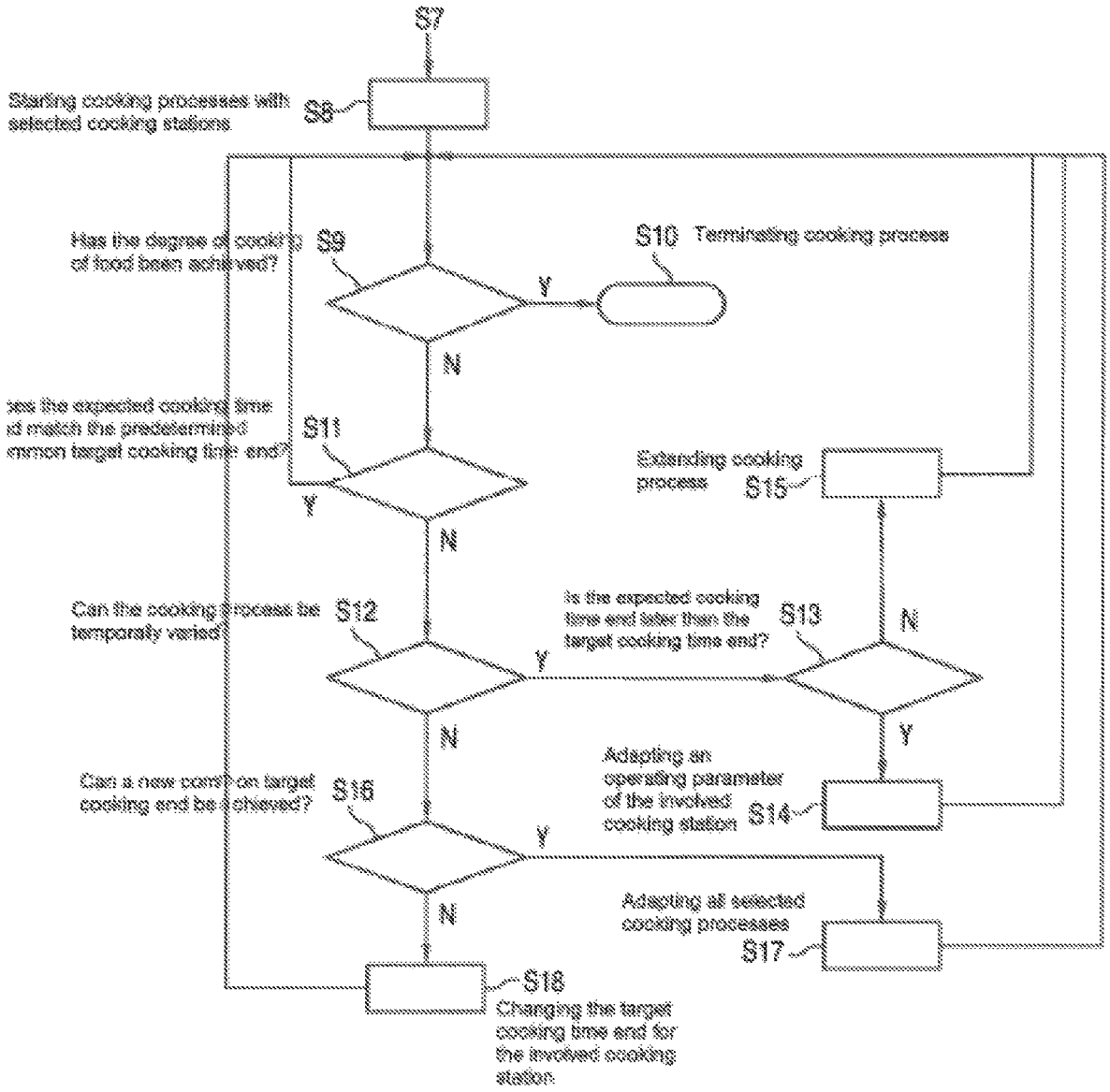
FIG. 3 shows further method steps for operating the cooking system.

FIG. 3 shows further method steps for operating the cooking system 1 to 4, G1 to GN, specifically after the timetable is activated in step S7 from FIG. 2.

In step S8, the cooking processes that are associated with the selected cooking stations G1 to GN are started at the start times that are determined from the timetable according to step S6, specifically in each case with the at least one (start) operating parameter, which is predetermined from the recipe or by a user, for example a cooking compartment temperature, a wattage, a cooking duration, a specific selection of heating bodies of an oven compartment In step S9, it is monitored or determined as to whether the degree of cooking of the food to be cooked that is to be prepared has achieved or has not yet achieved a respective target degree of cooking. If this is the case for a specific food to be cooked ("Y"), the associated cooking process is terminated in step S10, for example by switching off the associated cooking station G1 to GN.

If, on the other hand, this is not the case ("N"), a check is performed in S11 as to whether the expected cooking time end of this food to be cooked matches—at least within a predetermined temporal tolerance range—the predetermined common target cooking time end. If this is the case ("Y") the method branches back to step S9.

If this is not the case ("N"), a check is performed in step S12 as to whether this cooking process can be temporally varied by adapting or changing at least one associated operating parameter in such a way that the predetermined common target cooking time end would then be achieved by this cooking process.

If this is the case ("Y"), a check is performed in step S13 as to whether the prevailing calculated expected cooking time end is later than the target cooking time end ("Y") or not, in other words is earlier than the target cooking time end ("N"). If yes, in step S14 at least one operating parameter of this cooking station G1 to GN is adapted by the coordinating facility 1 and communicated to the associated cooking station G1 to GN or to the associated household cooking appliance 2 to 4 for setting in such a way that the cooking process is reduced according to the common target cooking time end.

If not ("N"), in step S15 at least one operating parameter of this cooking station G1 to GN is adapted by the coordinating facility and communicated to the associated cooking station G1 to GN or to the associated household cooking appliance 2 to 4 for setting in such a way that the cooking process is extended according to the common target cooking time end.

Following on from the steps S13 and S14, the method branches back to step S9.

If, however, it has been recognized in step S12 that this cooking process cannot be temporally varied by adapting or changing at least one associated operating parameter in such a way that the predetermined common target cooking time end would be achieved again ("N"), a check is performed in step S16 as to whether a new common target cooking time end can be achieved by temporally adapting all the other participating cooking processes.

If this is the case ("Y"), in step S17 all the other selected cooking processes are adapted (reduced, extended) by means of the coordinating facility 1 in such a way that a new common target cooking time end is expected to be achieved. The user can be notified of the change to the target cooking time end, for example by displaying a corresponding message on the coordinating facility 1. The method subsequently branches back to step S9.

If, however, this is not the case ("N"), in step S18 the target cooking time end is changed for this cooking process from an individual cooking time end that no longer matches the common target cooking time end of the other cooking stations G1 to GN, in other words "individualized", and the method then branches back to step S9. The user can be notified of this, for example by displaying an appropriate message on the coordinating facility 1.

Figure 4:
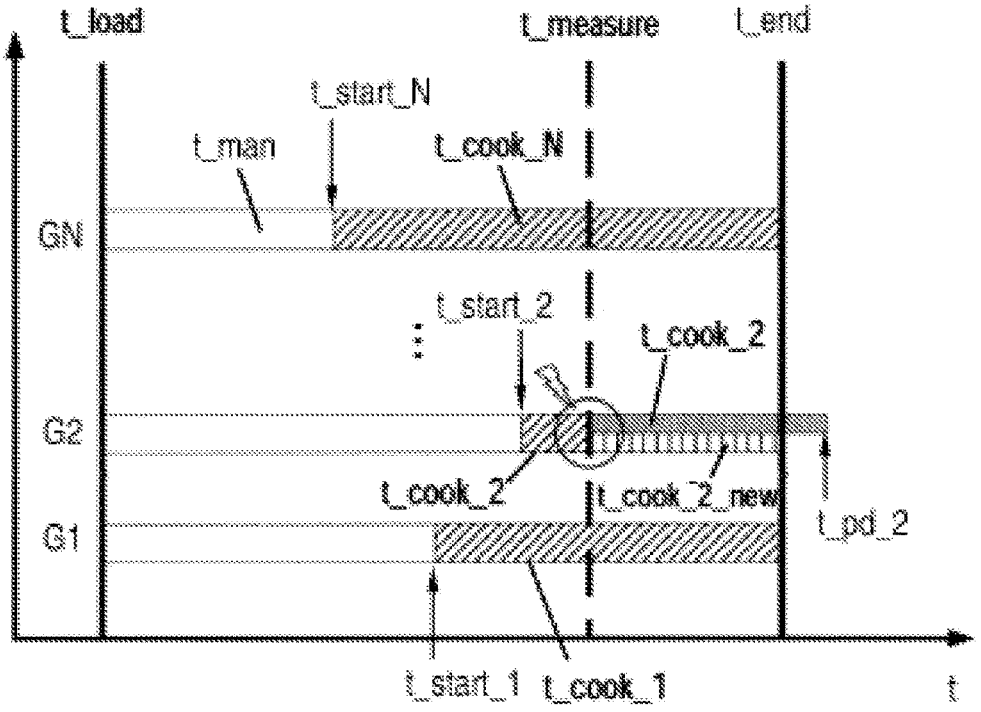
FIG. 4 shows a temporal progression of multiple cooking processes.

FIG. 4 shows a temporal progression of multiple cooking processes within the scope of food preparation, in particular using the method steps S1 to S18. In this case, only the cooking processes of the cooking stations G1, G2 and GN are illustrated but it is still also possible to operate further cooking stations G3 to G5 which behave here by way of example in a similar manner to the cooking processes of the cooking stations G1 and G7.

Food preparation should start at the latest at the last possible point in time t_load. The user can now perform manual preparation processes (such as indicated for the cooking station by t_man) and accordingly load the cooking stations G1 to GN that have been selected for the food preparation. If the cooking stations G1 to GN are loaded (which can be automatically determined or confirmed by a user), the associated cooking processes are automatically started by means of the coordinating facility 1 at the respective individual start times t_start_1, t_start_2, . . . , t_start_N by activating the associating cooking stations G1 to GN. The initial setting parameters correspond in this case advantageously to the setting parameters that are predetermined by the recipe/recipes or by a user, for example a cooking compartment temperature or cooking compartment profile for the cooking compartment G1, a cooking phase or a cooking phase profile for the cooking station G2, etc. In this case, the associated cooking durations t_cook_1, t_cook_2, . . . , t_cook_N are to be of such a length that all the cooking processes should be finished at the same target cooking time end t_end.

As of the start times t_start_1, t_start_2, . . . , t_start_N, the degrees of cooking of the food to be cooked that is located at the cooking stations G1 to GN is determined at for example regular intervals (as indicated by t_measure), and a check is performed on its basis as to whether the cooking processes will continue to be finished at the common target cooking time end t_end. This is the case here for the illustrated cooking stations G1 and GN without changes to their operating parameter, as indicated by the cooking durations t_cook_1 and t_cook_N.

Furthermore, the case is illustrated that the degree of cooking for the cooking station G2 is measured at a point in time t_measure and the expected cooking time end that is calculated therefrom is later than the common target cooking time end t_end (including a predetermined tolerance range) as indicated by the time duration t_cook_2 with the individual cooking time end t_pd_2.

A check is now performed as to whether the originally set target cooking time end tend can still be maintained at the cooking station G2 if the operating parameters of the cooking station G2 are adapted or changed in such a way that the associated cooking process can be accelerated without leaving its cooking time limit range. This is the case here: The coordinating facility 1 therefore determines new operating parameters, by setting new parameters the common target cooking time end t_end is maintained at the cooking station G2 (as is indicated by the time duration t_cook_2 new) and said coordinating facility transmits them to the cooking station G2 or to the associated household cooking appliance 2. The cooking station G2 or the household cooking appliance 2 accepts these adapted operating parameters and now uses them to control the cooking station G2. In the end result, all the cooking processes are as a result ready at the initially predetermined target cooking time end t_end. By way of example, the coordinating facility 1 can for this purpose increase a cooking phase of the cooking station G2.

Figure 5:
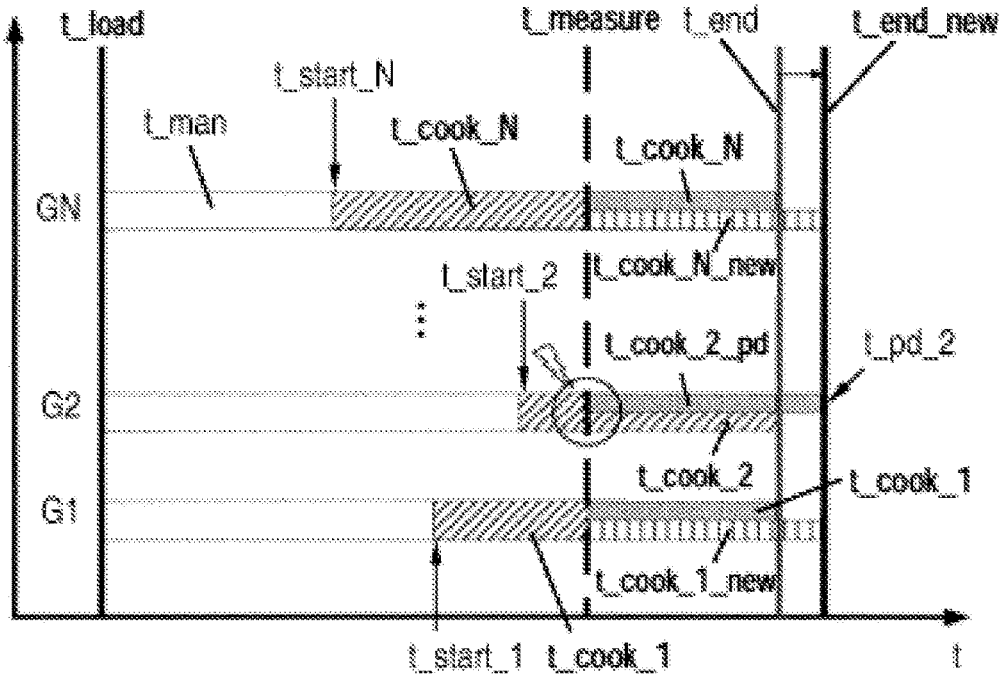
FIG. 5 shows a further temporal progression of multiple cooking processes.

FIG. 5 shows a further temporal progression of multiple cooking processes within the scope of food preparation in particular using the method steps S1 to S18. In this case, only the cooking processes of the cooking stations G1, G2 and GN are illustrated as in FIG. 4 but it is also possible to operate other cooking stations G3 to G5 etc. which behave here by way of example in a similar manner to the cooking processes at the cooking stations G1 and G7.

This progression is identical to FIG. 4 up to the point in time t_measure. In contrast to FIG. 4, the check as to whether the originally set target cooking time end t_end can be maintained at the cooking station G2 has however revealed that the at least one operating parameter of the cooking station G2 cannot be adapted or changed in such a way that the associated cooking process can be accelerated, by way of example because it then would have left its cooking time limit range, a maximum cooking phase is already set, etc. This is indicated by the time duration t_cook_2_pd without adapting the at least one operating parameter that ends at the point in time t_pd_2, wherein t_pd_2>t_applies.

The coordinating facility 1 therefore checks whether the cooking processes that are running at the other cooking stations G1, GN can be slowed down in such a way that all the cooking processes can be finished at a common new target cooking time end t_end_new, which matches here the predicted or expected cooking time end t_pd_2. It is assumed for the present exemplary embodiment that this is possible.

It is possible to output to the user information regarding the new target cooking time end t_end_new=t_pd_2. The user can confirm or discard the new target cooking time end t_end_new. If the new target cooking time end t_end_new is discarded, the operating parameters of the other cooking stations G1, GN are not changed, and the cooking process at the cooking station G2 is individually ended at the shortest possible cooking time end t_pd_2.

If the new common target cooking time end t_end_new is confirmed by the user, the coordinating facility 1 determines new operating parameters for the other cooking stations G1 GN, by setting new parameters the new target cooking time end t_end is maintained and said coordinating facility transmits them to these cooking stations G1, GN or to the associated household cooking appliances 2 to 4. The adapted operating parameters are accepted for these cooking stations G1, GN so that their cooking durations t_cook_1 new, t_cook_N new are extended accordingly. By way of example, the coordinating facility 1 can reduce a cooking compartment temperature of the cooking compartment G1 for this purpose.

In the end result, all the cooking processes are as a result ready at the new common target cooking time end t_end_new.

Naturally, the present invention is not limited to the illustrated exemplary embodiment.

In general, "a", "an" etc. can be understood to mean one or a plurality, in particular in terms of "at least one" or "one or more" etc. as long as this is not explicitly excluded, for example by the expression "precisely one", etc.

Also, a number specification can include precisely the quoted number and also a usual tolerance range, as long as this is not explicitly excluded.

The invention claimed is:

1. A cooking system, comprising:

at least two individually controllable cooking stations, each said cooking station being operably connected to at least one degree of cooking monitoring apparatus that is configured to ascertain a degree of cooking of food to be cooked that is located at the cooking station; and a coordinating facility connected to the cooking stations for data communication, said coordinating facility configured to set operating parameters of the cooking stations and to receive a first common target cooking time end that applies in common for the cooking stations;

said cooking system being configured:

during a cooking process running at the cooking stations, to determine an expected cooking time end in response to an ascertained degree of cooking, in response to the expected cooking time end for at least one of the cooking stations failing to match the first common target cooking time end, to determine whether an operating parameter for the at least one of the cooking stations can be adapted in such a way that the first common target cooking time end is achieved during running operation by the at least one of the cooking stations by comparing a first calculated cooking time which would result from applying the adapted operating parameter with a cooking limit time range for the at least one cooking station;

in response to the first calculated cooking time falling within the cooking limit time range, to adapt an operating parameter for the at least one of the cooking stations in such a way that the first common target cooking time end is achieved during running operation by the at least one cooking station; and in response to the first calculated cooking time falling outside the cooking limit time range, to adapt operating parameters for each other cooking station of the at least two individually controllable cooking stations to achieve a second common target cooking time end.

2. The cooking system of claim 1, wherein, when the expected cooking time end for the at least one of the cooking stations is temporally after the first common target cooking time end, the cooking system is configured to adapt the operating parameter for the at least one of the cooking stations in such a way that an associated cooking time is reduced.

3. The cooking system of claim 1, wherein, when the expected cooking time end for the at least one of the cooking stations is temporally before the first common target cooking time end, the cooking system is configured to adapt the operating parameter for this cooking station in such a way that an associated cooking time is extended.

4. The cooking system of claim 1, wherein, when the expected cooking time end for the at least one of the cooking stations cannot be matched to the first common target cooking time end, the cooking system is configured to adapt the second common target cooking time end to the expected cooking time end of the at least one of the cooking stations.

5. The cooking system of claim 4, wherein the cooking time range is delimited by a minimum cooking duration and a maximum cooking duration with regard to the cooking process.

6. The cooking system of claim 1, wherein the cooking system is configured to specify start times individually for cooking processes that are allocated to the cooking stations.

7. The cooking system of claim 1, wherein the cooking system is configured to create a timetable prior to a start of a cooking process.

8. A method for operating a cooking system which includes at least two individually controllable cooking stations, said method comprising:

determining during a running cooking operation an expected cooking time end for each of the at least two cooking stations in response to an ascertained degree of cooking;

comparing the expected cooking time end to a first common target cooking time end that is common for the at least two cooking stations;

in response to the expected cooking time end for at least one of the at least two cooking stations failing to match the first target cooking time end that is common for the at least two cooking stations, determining whether an operating parameter for the at least one of the at least two cooking stations can be adapted in such a way that the first common target cooking time end is achieved during running operation by the at least one of the cooking stations by comparing a first calculated cooking time which would result from applying the adapted operating parameter with a cooking limit time range for the at least one cooking stations;

in response to the first calculated cooking time falling within the cooking limit time range, adapting an operating parameter for the at least one of the at least two cooking station in such a way that the first common target cooking time end is achieved during the running operation by the at least one of the at least two cooking stations;

in response to the first calculated cooking time falling outside the cooking limit time range, adapting operating parameters for each other cooking station of the at least two individually controllable cooking stations to achieve a second common target cooking time end; and controlling each cooking station of the at least two individually controllable cooking stations based on the adapted operating parameters.

* * * * *